US008533918B1

(12) United States Patent
Ketter et al.

(10) Patent No.: US 8,533,918 B1
(45) Date of Patent: Sep. 17, 2013

(54) AUTOMATIC ZIPPER

(76) Inventors: Meridee Ketter, North Salt Lake, UT (US); Gentry Brown, West Valley City, UT (US)

( * ) Notice: Subject to any disclaimer, the term of this patent is extended or adjusted under 35 U.S.C. 154(b) by 0 days.

(21) Appl. No.: 13/473,421

(22) Filed: May 16, 2012

(51) Int. Cl.
*A44B 19/24* (2006.01)
*A44B 19/26* (2006.01)
*A41D 1/00* (2006.01)

(52) U.S. Cl.
USPC ..... 24/387; 24/429; 2/234; 2/218; 2/405

(58) Field of Classification Search
USPC ..... 24/234, 439, 429, 436, 387; 2/218, 2/236, 237, 234, 405
See application file for complete search history.

(56) References Cited

U.S. PATENT DOCUMENTS 2,223,347 A 12/1940 Axthelm
2,408,688 A * 10/1946 Schonthal ..... 2/251
2,656,579 A 10/1953 Wilson
2,675,559 A 4/1954 Miller
3,448,463 A 6/1969 Milone
4,928,363 A 5/1990 Easton
5,400,480 A 3/1995 Futch, III
5,586,368 A 12/1996 Nelson
7,111,714 B1 9/2006 Bell, III
7,200,901 B2 4/2007 Pitts et al.
7,971,279 B2 7/2011 Abanto et al.
2002/0157697 A1* 10/2002 Choi ..... 135/119
2007/0006366 A1 1/2007 Barnard
2007/0289110 A1* 12/2007 Bekeschus ..... 24/436
2008/0052880 A1 3/2008 Sullivan
2012/0017402 A1* 1/2012 Feinberg ..... 24/387

* cited by examiner

*Primary Examiner* — Robert J Sandy
*Assistant Examiner* — Michael Lee
(74) *Attorney, Agent, or Firm* — Kunzler Law Group, PC

(57) ABSTRACT

An apparatus, system, and method are disclosed for an automatic zipper. An apparatus for an automatic zipper includes a first placket tab and a second placket tab located on opposing sides of a zipper. The zipper also includes a slider body. The apparatus also includes a zipper connector permanently coupling the slider body to an anchor location on the first placket tab. The zipper connector is substantially non-stretchable and has a length such that the zipper connector maintains the distance between the anchor location and the slider body to be substantially the same or less than the distance between the anchor location and the slider body in the closed position.

14 Claims, 4 Drawing Sheets

AUTOMATIC ZIPPER

FIELD OF THE INVENTION

This invention relates to zippers and more particularly relates to an automatic zipper.

BACKGROUND

Zippers are a common closure mechanism for fastening edges of a flexible material together. Articles of clothing often utilize zippers alone or in combination with other types of closure mechanisms so that a user can close an opening and/or secure the clothing on the user's body. For example, zippers are common on trousers, coats, and many other types of clothing.

However, some individuals may find it difficult to grasp the pull tabs on a zipper. For example, zipper pull taps may be very small and may be difficult to grasp for the average person. Additionally, even average or large zipper pull tabs may be difficult to grasp with arthritic fingers or fingers lacking average strength of feeling. Often, even if an individual is able to zip up a zipper, the individual may forget or the zipper may become unzipped during normal use. Individuals may find it embarrassing to be caught with their zippers not fully zipped.

SUMMARY

From the foregoing discussion, it should be apparent that a need exists for an apparatus, system, and method that enable easy and efficient zipping and unzipping of a zipper. Beneficially, such an apparatus, system, and method would maintain the zipper in a closed position when desired and reduce the chance that a user will zip the zipper.

The present invention has been developed in response to the present state of the art, and in particular, in response to the problems and needs in the art that have not yet been fully solved by currently available zippers. Accordingly, the present invention has been developed to provide an apparatus, system, and method for an automatic zipper that overcomes many or all of the above-discussed shortcomings in the art.

An apparatus, system, and method are disclosed for an automatic zipper. An apparatus includes a first placket tab and a second placket tab located on opposing sides of a zipper. The zipper includes a slider body. The apparatus also includes a zipper connector permanently coupling the slider body to an anchor location on the first placket tab. The zipper connector is substantially non-stretchable and has a length such that the zipper connector maintains the distance between the anchor location and the slider body to be substantially the same or less than the distance between the anchor location and the slider body in the closed position.

In one embodiment, the apparatus includes a securing mechanism for selectively securing the first placket tab to the second placket tab at a location near the closed position of the slider body. In a further embodiment, the anchor location is at the same location as a portion of the securing mechanism. In yet another embodiment, the zipper connector is coupled to the first placket tab via a portion of the securing mechanism. In one embodiment, the zipper connector is flexible. In another embodiment, the zipper connector includes a non-stretchable cord. In a further embodiment, the zipper connector includes a lobster clasp.

A method of the present invention is also presented for opening and closing a zipper that includes a slider body and is on an article of clothing. The method includes separating, when the zipper is closed, a first placket tab from a second placket tab and folding the zipper. Separating the first and second placket tabs causes an elongate, non-stretchable zipper connector connecting the slider body to the first placket tab to draw the slider body toward the zipper's open position. The method further includes drawing, when the zipper is open, the first and second placket tabs together and straightening the zipper. Straightening the zipper causes the zipper connector to draw the slider body toward the zipper's closed position.

In one embodiment, the method includes permanently connecting one end of the zipper connector to the slider body. In a further embodiment, the method includes permanently connecting the other end of the zipper connector to an anchor location on a first placket tab located near the zipper's closed position. In one embodiment, the zipper connector has a length such that the zipper connector maintains the distance between the anchor location and the slider body to be substantially the same or less than the distance between the anchor location and the slider body in the closed position.

In one embodiment, the method further includes detaching a securing mechanism that selectively secures the first placket tab to the second placket tab. In a further embodiment, the method further includes attaching the securing mechanism to secure the first placket tab to the second placket tab. In one embodiment, the zipper connector secures the slider body in substantially the closed position when the securing mechanism is attached. In yet another embodiment, separating the first placket tab from the second placket tab and folding the zipper is performed in response to detaching the securing mechanism and attaching the securing mechanism is performed in response to drawing the first and second placket tabs together and straightening the zipper.

In one embodiment, the distance between the anchor location and the slider body is maintained at a length substantially equal to or less than the distance between the anchor location and the slider body in the closed position.

An article of clothing of the present invention is also presented. An article of clothing includes a first placket tab and a second placket tab located on opposing sides of a zipper. The zipper includes a slider body. The article of clothing also includes a zipper connector permanently coupling the slider body to an anchor location on the first placket tab. The zipper connector is substantially non-stretchable and has a length such that the zipper connector maintains the distance between the anchor location and the slider body to be substantially the same or less than the distance between the anchor location and the slider body in the closed position.

In a further embodiment, the article of clothing is configured to be worn on and cover a portion of a user's body. In yet another embodiment, the article of clothing is substantially retained on the user's body when the zipper is closed and, when the zipper is open, the article of clothing is removable from the user's body. In one embodiment, the article of clothing includes trousers. In another embodiment, the article of clothing includes one of a shirt, a jacket, a coat, and a blouse. In yet another embodiment, the article of clothing includes one of a skirt and a dress.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
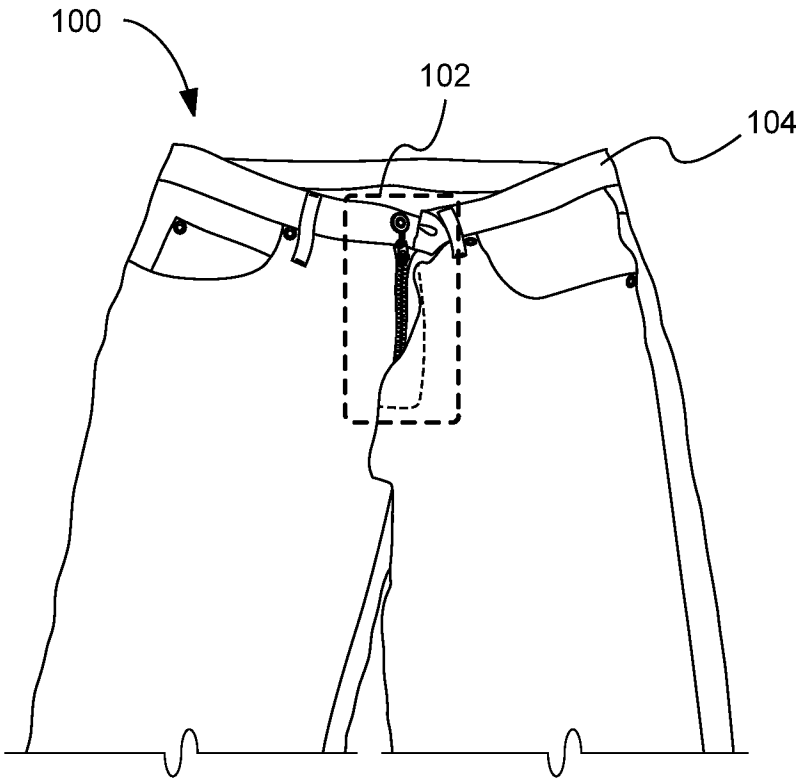
FIG. 1 is a perspective view illustrating one embodiment of a trousers with an automatic zipper in accordance with the present invention.

FIG. 1 illustrates trousers 100 that include an automatic zipper mechanism. The automatic zipper mechanism is located on the placket 102. As given herein the term placket 102 is given to mean a slit or opening in an article as well as the material, mechanisms and structures surrounding the slit or opening. For example, the placket 102 is illustrated as an area surrounding an opening in a pair of trousers 100 as indicated by box 102. In the depicted embodiment, the pair of trousers 100 includes a waistband 104. In one embodiment, the placket 102 may be opened to increase the circumference of the waistband 104 and allow the trousers 100 to be put on or removed. When worn, the placket 102 may be closed to secure the waistband 104 at a smaller circumference so that the trousers 100 may remain in place on an individual.

Although FIG. 1 depicts a pair of trousers 100, an automatic zipper as disclosed herein may be applicable to any article that includes a zipper, for example articles of clothing, bags, or the like. However, for clarity and illustrative purposes the present disclosure discusses an automatic zipper mechanism in the context of articles of clothing, and more specifically, trousers. Other exemplary embodiments may include zippers on a blouse, shirt, jacket, coat, skirt, dress, footwear, or any other article of clothing. Yet other embodiments may include zippers on bags such as handbags, duffle bags, luggage, or the like. In light of the present disclosure one of skill in the art will recognize various modifications which may be desirable or necessary depending on the article on which an automatic zipper is located. For example, in other embodiments, a zipper mechanism or placket 102 may be opened or closed to gain access to an interior of a pocket, an enclosed cavity, or any article of clothing.

Figure 2:
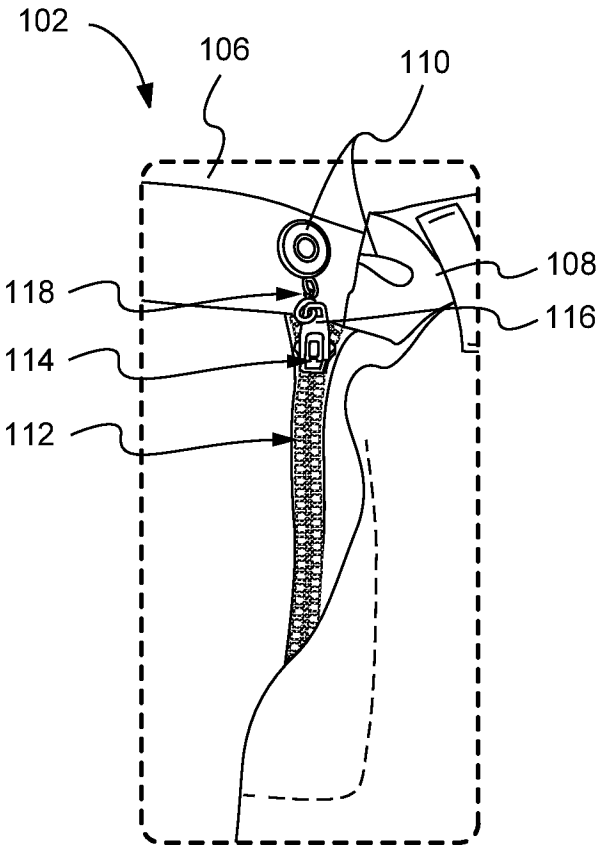
FIG. 2 is a close up view of the placket of FIG. 1 showing the components of an automatic zipper in accordance with the present invention.

FIG. 2 illustrates a close-up view of the placket 102 of the trousers 100 of FIG. 1. The placket 102 includes a number of components including a first placket tab 106, a second placket tab 108, securing mechanism 110, zipper teeth 112, a slider body 114, a zipper pull tab 116, and a zipper connector 118.

The first and second placket tabs 106, 108 are graspable portions of material on either side of the placket 102. The first and second placket tab 106, 108 may be located on opposing sides of a zipper. The first and second placket tabs 106, 108 are located in line with the waistband 104 and may present areas which are graspable to pull the waistband 104 towards a closed circumference. In the depicted embodiment, the first and second placket tabs 106, 108 include a securing mechanism 110 for securing the first placket tab 106 to the second placket tab 108. The securing mechanism 110 includes a button on the first placket tab 106 and a corresponding slit in the second placket tab 108 to form a buttonhole. In other embodiments, the securing mechanism 110 may include any type of securing mechanism to secure the first placket tab 106 to the second placket tab 108. Exemplary securing mechanisms 110 may include a button and button loop mechanism, a hook and eye mechanism, a button and buttonhole mechanism, a snapping button mechanism, a hook and loop mechanism (such as Velcro®), or the like.

The zipper teeth 112 include opposing sets of teeth on opposite sides of the opening or placket 102. In one embodiment, the slider body 114 is slidable along the zipper teeth 112 to selectively release and secure the zipper teeth 112. For example, as the slider body 114 is slid towards an open position (such as downward in the depicted embodiment) the slider body 114 separates the teeth 112 and opposing sides of the placket 102 are released from each other. In contrast, as the slider body 114 is slid towards a closed position (such as upward in the depicted embodiment) the slider body 114 secures the teeth 112 and opposing sides of the placket 102 are secured to each other. When the zipper teeth 112 are secured, opposing sides of the placket 102 are secured to each other and access through the placket 102 opening is limited. When the zipper teeth 112 are released, opposing sides of the placket 102 are free from each other and access through the placket 102 opening is not limited.

In one embodiment, the slider body 114 includes a zipper pull tab 116 that extends from the slider body 114 and provides a graspable surface to adjust the position of the slider body 114, and thereby controls whether the zipper is closed or opened. For example, a user may grasp the zipper pull tab 116 to pull the slider body 114 upwards or downwards to selectively secure and/or release the zipper teeth 112. The zipper pull tab 116 and other components of the zipper may be formed of a variety of materials. For example, the zipper teeth 112, slider body 114, and zipper pull tab 116 may be formed of one or more of a metal, nylon, a plastic, or the like.

The zipper connector 118 couples the slider body 114 to the first placket tab 106 at an anchor location. In one embodiment, the zipper connector 118 may be coupled directly to the slider body 114. In another embodiment, the zipper connector 118 is coupled to the slider body 114 via the zipper pull tab 116. The zipper connector 118 is connected to the first placket tab 106 at an anchor location. In one embodiment, the anchor location is a location on the first placket tab 106 near a closed position of the slider body 114. For example, the closed position of the slider body 114 may be a position where most or substantially all of the teeth 112 have been secured by the slider body 114 and maintain the placket 102 opening closed. In one embodiment, the closed position and open position of the slider body 114 are located at substantially opposite ends of the teeth 112. In one embodiment, the closed position of the slider body 114 is closer to the open position of the slider body 114 than the anchor location on the first placket tab 106.

In one embodiment, the anchor location is the location of a portion of the securing mechanism 110. For example, in the depicted embodiment, the zipper connector 118 is coupled to the button of the securing mechanism 110. In other embodiments, the zipper connector 118 may be coupled directly to the first placket tab 106, the second placket tab 108, to the button hole, or the like. For example, the zipper connector 118 may be coupled to the fabric of the first placket tab 106 via one or more hooks, sewn thread, or any other mechanism.

In one embodiment, the zipper connector 118 permanently couples the slider body 114 to the first placket tab 106. As used herein, the term permanently couple is given to mean that the zipper connector 118 is not removed during general use. For example, the zipper connector 118 may be permanently coupled in that, in one embodiment, it remains coupled to the slider body 114 and the first placket tab 106 during removing, putting on, wearing, and storing of an article of clothing.

In one embodiment, the zipper connector 118 is elongate and substantially non-stretchable. One of skill in the art will recognize that most all materials may stretch to some extent under tension. However, the zipper connector 118 may be non-stretchable in that it has a generally fixed maximum length that does not increase under the amount of tension encountered during use on a zipper. For example, the zipper connector 118 may be sufficiently strong and non-stretchable such that under the forces on the zipper connector 118 during zipping, unzipping, and/or wearing the zipper connector 118 has a substantially fixed maximum length. The zipper connector 118 may be flexible and allow for bending of the zipper connector 118. For example, the zipper connector 118 may be flexible from a straightened position to a bent position similar to a non-stretchable cord, chain, or the like. One of skill in the art will understand that even though the zipper connector 118 is non-stretchable it may be fairly flexible due to give in linkages between components of the zipper connector 118, how a fiber material is braided to form a cord, etc.

In one embodiment, the zipper connector 118 has a length such that the anchor location on the first placket tab 106 is maintained at substantially a desired coupling distance from the slider body 114. In one embodiment, the coupling distance is substantially the same as the distance from the slider body 114 to the anchor location when the slider body 114 is in a closed position. In one embodiment, the zipper connector 118 maintains the distance between the anchor location and the slider body 114 such that it is substantially permanently equal to or less than the coupling distance. Additionally, the zipper connector 118 may be coupled to the slider body 114 directly or via the zipper pull tab 116. Thus, the length of the zipper connector 118 may depend on a desired coupling as well as whether the zipper connector 118 will be connected directly to a slider body 114 or to a zipper pull tab 116.

Figure 3:
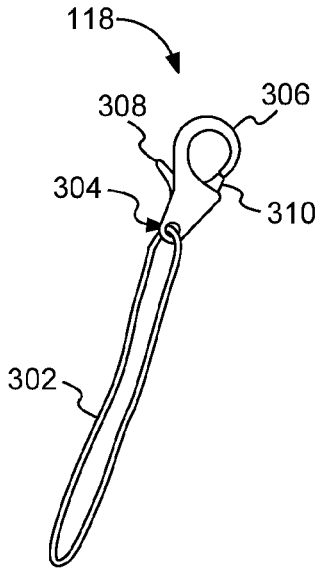
FIG. 3 is a side view illustrating one embodiment of a zipper connector in accordance with the present invention.

FIG. 3 illustrates one embodiment of a zipper connector 118 for coupling a first placket tab 106 to a slider body 114. The zipper connector 118 includes cord 302 coupled to an eye 304 of a lobster clasp 306. The cord 302 may be made from a variety of materials such as natural or synthetic fibers. Exemplary materials include linen, cotton, nylon, or the like. In one embodiment, the cord 302 may be made of materials and/or constructed such that it is substantially non-stretchable. For example, the cord 302 may experience little or no stretching in response to forces encountered during zipping, unzipping, and wearing trousers. In one embodiment, cord 302 that is substantially non-stretchable may help retain the anchor location on the first placket tab 106 and the slider body 114 at or less than a substantially fixed coupling distance.

The lobster clasp 306 may be any type of lobster clasp 306 known in the art. For example, any lobster clasp 306 used on jewelry or as a fastener in other fields may be used in various embodiments. The same or similar clasps may be referred to by other names such as a ring clamp, Bocklebee clasp, ring clasp, or other names. In the depicted embodiment, the cord 302 is coupled to the lobster clasp 306 through an eye 304 on the body of the lobster clasp 306. The lobster clasp 306 also includes a lever 308 which can be manipulated to actuate a gate 310. According to one embodiment, a spring biases the gate 310 up against an opposing portion of the lobster clasp 306 such that an object engaged by the hook portion will be retained within the hook. This may keep an object engaged by the lobster clasp 306 until the lever 308 is manipulated to retract the gate 310.

The zipper connector 118 of FIG. 3 is exemplary only. Considerable variation is possible and may be desirable in various embodiments. For example, the zipper connector 118 of FIG. 3 may be used to retrofit a zipper of an existing article of clothing to operate as an automatic zipper. Other embodiments may be designed to be built into a zipper or as part of an article of clothing such that the article of clothing is sold with the zipper connector 118. For example, the zipper connector 118 may be made so that it is physically difficult to remove and may include welded, fused, sewn, or molded parts.

Exemplary variations in the zipper connector 118 may include swapping the lobster clasp 306 and/or the cord 302 for one or more alternate parts. For example, the lobster clasp 306 and/or the cord 302 may be replaced, in some embodiments, with one or more links, rings, clasps, closable links, or the like. According to one embodiment, various parts that are used in jewelry such as earrings, necklaces, bracelets, or any other type of jewelry may be used to create the zipper connector 118. In one embodiment, the zipper connector 118 may be ornamental and function as a piece of jewelry itself. One or more ornamental features may be included on the zipper connector 118 in some embodiments. In one embodiment, the zipper connector 118 may be formed to be very small and unnoticeable. For example, it may be desirable that the zipper connector 118 is largely not noticed by others when worn. Thus, there may be some motivation to make the zipper connector as small as possible while remaining the strength needed during operation.

The materials of the zipper connector 118 may be formed of a variety of materials. For example, metals, plastics, nylon, or other synthetic or natural materials may be used to make the zipper connector 118 or parts of the zipper connector 118.

Figure 4:
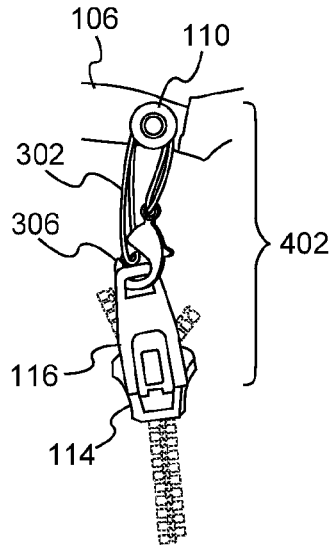
FIG. 4 is a front view illustrating the zipper connector of FIG. 3 coupled to a slider body and a placket tab in accordance with the present invention.

FIG. 4 illustrates the zipper connector 118 of FIG. 3 coupled between a first placket tab 106 and a slider body 114. The cord 302 is looped over a button that forms a portion of a securing mechanism 110. Thus, the securing mechanism 110 acts as an anchor location. The cord 302 is coupled at one end to an eye 304 of the lobster clasp 306 while the other end is looped through and engaged by the hook and gate 310 of the lobster clasp 306. The hook of the lobster clasp 306 is also coupled to the slider body 114 via a zipper pull tab 116.

According to one embodiment, the zipper connector 118 is substantially non-stretchable such that the coupling distance 402 between the anchor location (the securing mechanism 110, in the depicted embodiment) and the slider body 114 may be held substantially constant. A zipper pull tab 116 may not be used in all embodiments. For example, in one embodiment, the zipper connector 118 may be coupled directly to the slider body 114 rather than to a zipper pull tab 116. As will be understood by one skilled in the art in light of the present disclosure, the zipper connector 118 may have a length greater than the coupling distance 402 because it is looped back on itself. The length of the zipper connector 118 may vary considerably depending on the article of clothing to which it is attached and the distance between an anchor location and a slider body 114 as well as whether the zipper connector 118 is connected directly to the slider body 114 or to a zipper pull tab 116.

Figure 5:
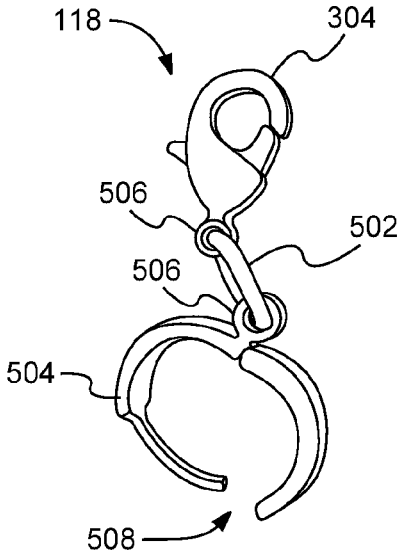
FIG. 5 is a side view illustrating another embodiment of a zipper connector in accordance with the present invention.

FIG. 5 illustrates another example of a zipper connector 118 for coupling a first placket tab 106 to a slider body 114. The zipper connector 118 includes a lobster clasp 306 similar to the zipper connector 118 of FIG. 3. However, rather than a cord 302, the zipper connector 118 of FIG. 5 includes a jump ring 502, and a closable link 504. The jump ring 502 couples the lobster clasp 306 to the closable link 504 using respective eyes 506.

According to one embodiment, the jump ring 502 has a discontinuity which may allow the jump ring 502 to be deformed and removed from the respective. For example, the jump ring 502 may include a portion of wire which is shaped to form a circle. However, where the ends meet there is no connection or welding but rather the ends may be pried apart from each other to create a large enough gab to insert the jump ring into an eye 506 or other coupling feature.

The closable link 504 comprises a link which may be opened and closed to selectively engage another link, a securing mechanism 110, or the like. According to one embodiment, a closable link 504 is any link which may be opened and closed without deformation of the link. The depicted closable link 504 comprises an eye 506 and a hinge point where the closable link 504 is allowed to pivot to open and close. Exemplary closable links 504 may include a variety of jewelry, or jewelry connectors. For example, earrings, connectors for necklaces and bracelets, or other connectors may be operable as closable link. In fact, some embodiments may use earrings which are available in the art to operate as closable links 504 on a zipper connector 118.

Figure 6:
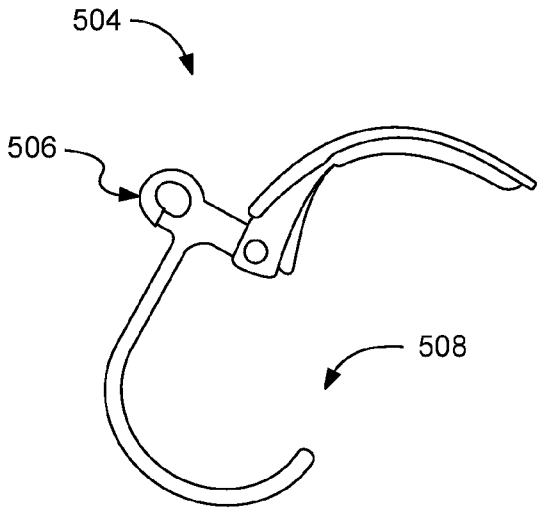
FIG. 6 is a side view illustrating one embodiment of a closable link in accordance with the present invention.

The closable link 504 on the zipper connector 118 of FIG. 5 includes an opening 508 where loops, securing mechanisms 110, zipper pull tabs 116, or other objects to be coupled to can be inserted. The opening 508 is shown substantially directly opposite the eye 506. According to one embodiment, an opening 508 directly opposite an eye 506 may make it easier to couple the closable link 504 to another object, such as button, zipper pull tab 116, etc. However, in some embodiments, an opening 508 opposite an eye 506 may increase chances that the zipper connector 118 will come free during use. FIG. 6 illustrates one embodiment of a closable link 504 having an opening 508 on a side rather than opposite an eye 506. According to one embodiment, even if the closable link 504 opens during use, the closable link 504 may still be retained on a securing mechanism 110 or slider body 114.

Figure 8:
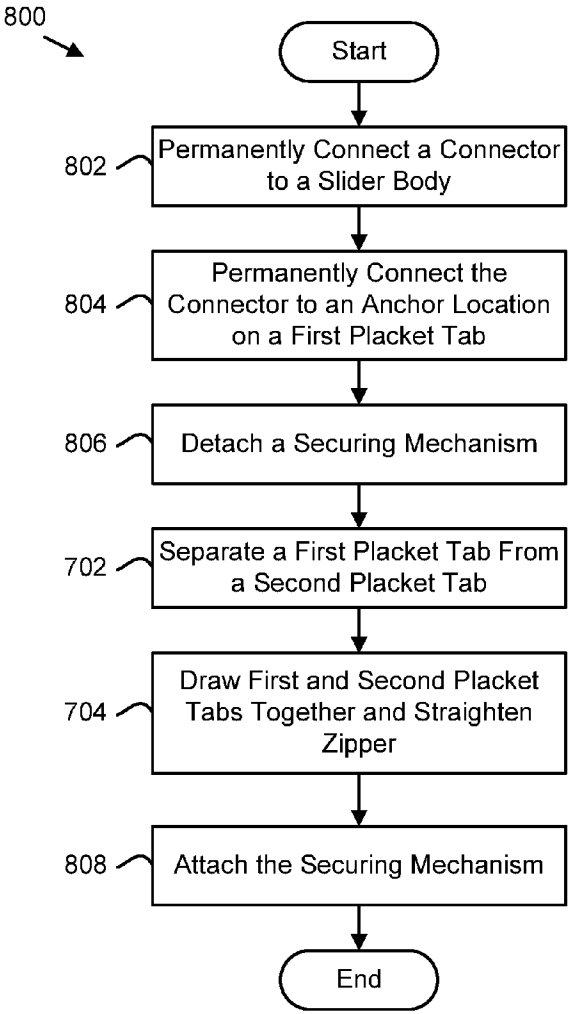
FIG. 8 is a schematic block diagram illustrating another embodiment of a method for unzipping a zipper in accordance with the present invention.
Figure 7:
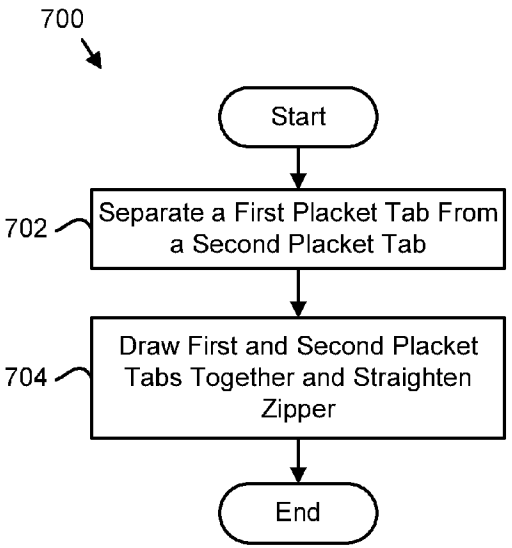
FIG. 7 is a schematic block diagram illustrating one embodiment of a method for unzipping a zipper in accordance with the present invention.
Figure 9:
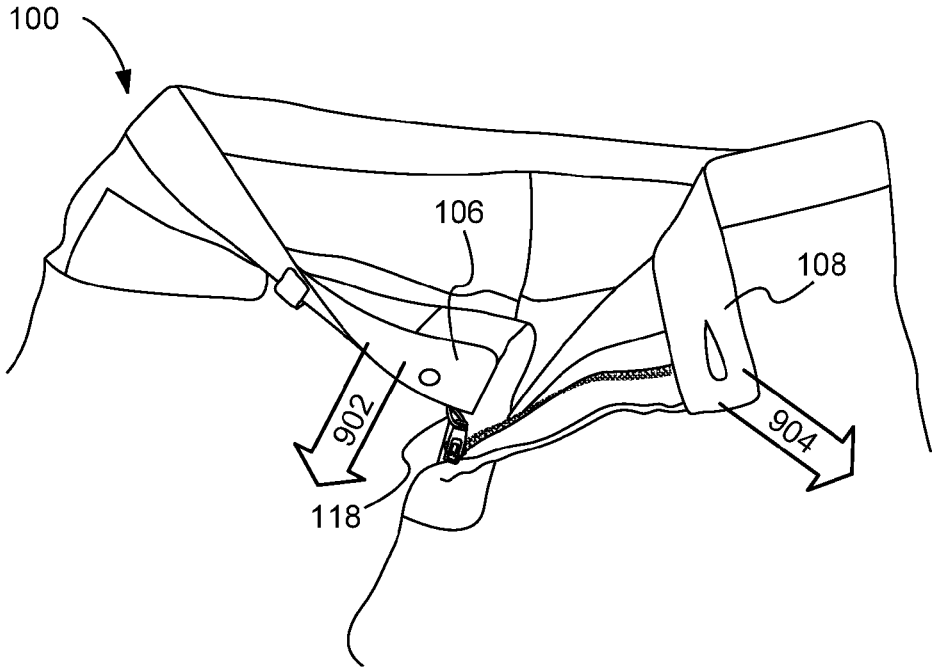
FIG. 9 is a front view illustrating the first and second plackets being separated in accordance with the present invention.
Figure 10:
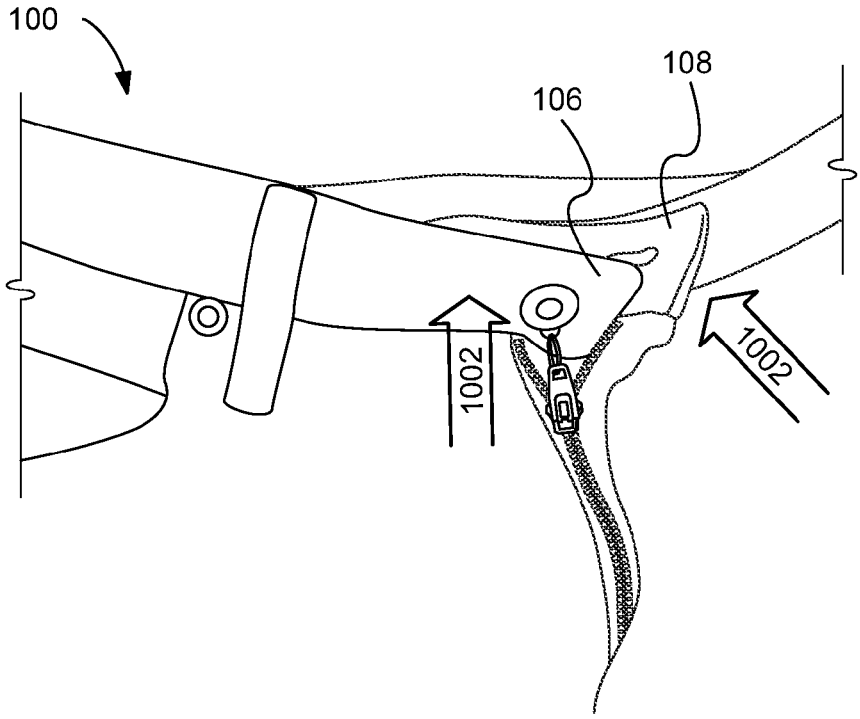
FIG. 10 is a front view illustrating the first and second plackets being drawn together in accordance with the present invention.

Exemplary methods for use of a zipper connector 118 and/or automatic zipper will be illustrated in relation to FIGS. 7-10. Specifically, FIGS. 7 and 8 illustrate exemplary methods 700, 800 and FIGS. 9 and 10 illustrate exemplary steps of the methods. FIG. 7 illustrates a method 700 of opening and closing a zipper. The method 700 may be performed on the trousers 100 and/or placket 102 of FIGS. 1 and 2. The method 700 may also be performed on any article of clothing, bag, or other object that includes a zipper.

The method 700 begins and a first placket tab 106 is separated 702 from a second placket tab 108. For example, a user may grip each of the placket tabs 106, 108 with respective hands and apply pressure to separate them. In one embodiment, the zipper is closed prior to separating 702 the first placket tab 106 from the second placket tab 108. For example, the separating step 702 may be performed when the trousers 100 are on an individual and the zipper is closed. As a further example, the drawing together step 704 may be performed in response to the drawing together step 704, which is discussed below. The separating step 702 may be performed in preparation for removal from an individual or putting the trousers 100 on an individual.

In one embodiment, as the zipper is separated 702, the zipper is folded, or looped over such that the zipper is no longer substantially straight. In one embodiment, the folding of the zipper during separation 702 of the placket tabs 106, 108 is due, at least in part, to the non-stretchable nature of the zipper connector 118. For example, a non-stretchable zipper connector 118 may keep the anchor location on the first placket tab 106 no greater than a coupling distance away from the slider body 114. This may require that the zipper or a portion of the zipper teeth 112 be folded in order to allow, or force, the zipper to unzip.

In one embodiment, as the first placket tab 106 is separated 702 from the second placket tab 108 the zipper connector 118 is caused to draw the slider body 114 down toward an open position of the zipper. The tension on the zipper connector 118 between the first placket tab 106 and the slider body 114 as the placket tabs 106, 108 are separated may create a force in a direction that causes the slider body 114 to be drawn towards an open position. As the slider body 114 slides towards the open position the zipper teeth 112 are separated and the placket 102 opening is opened.

According to one embodiment, the separation 702 of the placket tabs 106, 108 allows the zipper to unzip without the user touching the slider body 114 or zipper pull tab 116. Unzipping without touching the slider body 114 or zipper pull tab 116 may make it simpler and faster to unzip a zipper. Additionally, unzipping without touching the slider body 114 or zipper pull tab 116 may make it easier to unzip the zipper because it may not be required to grasp a small zipper pull tab 116 in order to unzip the zipper.

FIG. 9 illustrates the separation 702 of the first and second placket tabs 106, 108 on trousers 100. The first placket tab 106 is shown being separated 702 from the second placket tab 108. Arrows 902 and 904 illustrate exemplary direction of movement of the placket tabs 106, 108. Hands or other objects that applying a force or tension to separate 702 the placket tabs 106, 108 are not shown for clarity. The zipper connector 118 is shown maintaining an anchor location at or less than a substantially fixed coupling distance. The first placket tab 106 is shown folded such that zipper teeth 112 are folded and not substantially straight. According to one embodiment, force in the direction of arrows 902, 904 may be applied until the slider body 114 is in an open position.

In one embodiment, the method 700 includes drawing 704 the first and second placket tabs 106, 108 together. For example, a user may grip each of the placket tabs 106, 108 with respective hands and apply pressure to draw 704 them towards each other. In one embodiment, the zipper is open prior to drawing 704 the first placket tab 106 toward the second placket tab 108. For example, the drawing together step 704 may be performed in when the trousers 100 are on an individual and the zipper is open and may be performed to secure the trousers 100 on the individual. As a further example, the drawing together step 704 may be performed in response to the separating step 702. The drawing together step 704 may be performed in preparation for storage or for securing the trousers 100 on the individual.

In one embodiment, as the first and second placket tabs 106, 18 are drawn 704 together, the zipper is straightened. In one embodiment, as the first placket tab 106 and the second placket tab 108 are drawn 704 together, the zipper connector 118 is caused to draw the slider body 114 toward a closed position. The tension on the zipper connector 118 between the first placket tab 106 and the slider body 114 as the placket tabs 106, 108 are drawn 704 together may create a force in a direction that causes the slider body 114 to be drawn up towards a closed position. As the slider body 114 slides towards the closed position the zipper teeth 112 are secured and the placket 102 opening is shut.

According to one embodiment, the drawing 704 together of the placket tabs 106, 108 allows the zipper to be zipped without the user touching the slider body 114 or zipper pull tab 116. Zipping without touching the slider body 114 or zipper pull tab 116 may make it simpler and faster to unzip a zipper. Additionally, zipping without the additional step required to grab the zipper pull tab 116 may result in it being very difficult to forget to zip up a zipper. Additionally, zipping without touching the slider body 114 or zipper pull tab 116 may make it easier to zip the zipper because it may not be required to grasp a small zipper pull tab 116 in order to zip the zipper.

FIG. 10 illustrates the drawing 704 together of the first and second placket tabs 106, 108 on trousers 100. The first placket tab 106 is shown being drawn 704 towards the second placket tab 108. Arrows 1002 and 1004 illustrate exemplary direction of movement of the placket tabs 106, 108. Hands or other objects that applying a force or tension to draw 704 the placket tabs 106, 108 together are not shown for clarity. The zipper connector 118 is shown maintaining an anchor location on the first placket tab 106 at or less than a substantially fixed coupling distance. The first placket tab 106 is shown straightening such that zipper teeth 112 are approaching becoming substantially straight. According to one embodiment, force in the direction of arrows 1002, 1004 may be applied until the slider body 114 is in closed position.

According to one embodiment, the zipper connector 118 used in the method 700 above is substantially non-stretchable. A non-stretchable zipper connector 118 may function better as movement of the first placket tab 106 may correspond to direct movement of the zipper slider body 114. This may enable to more efficiently and effectively zip up a zipper or manipulate the placket tabs 106, 108 when a zipper is stuck or hung. In one embodiment, a non-stretchable zipper connector 118 may last longer because no elasticity must be maintained. In some embodiments, stretchable connectors may wear out quicker and lose their elasticity and thus fail to zip a zipper all the way closed. Additionally, a non-stretchable zipper connectors 118 may maintain a zipper in a closed condition during wearing of trousers 100 or other articles of clothing. For example, a stretchable zipper connector 118 may allow a slider body 114 to slide partially down during wearing, even if the wearer had initially pulled the slider body 114 to a closed position.

Turning to FIG. 8 another method 800 for opening and closing a zipper is illustrated. The method 800 includes the steps 702, 704 of the method 700 of FIG. 7 and may include any of the variations discussed above. Additionally, method 800 includes a plurality of additional steps 802 which may be included in some embodiments. The method 800 may be performed using trousers 100, plackets 102, According to one embodiment, steps 802 and 804 may be included to mount a zipper connector 118. In one embodiment, the method 800 may include permanently connecting 802 a zipper connector 118 to a slider body 114. According to one embodiment, permanently connecting 802 the zipper connector 118 to the slider body 114 may include connecting the zipper connector 118 directly to the slider body 114 or to a zipper pull tab 116. In one embodiment, the permanently connecting 802 the zipper connector 118 to the slider body 114 may include connecting the zipper connector 118 such that it cannot be removed without damage to the zipper connector 118 and/or a portion of the zipper. In another embodiment, permanently connecting 802 the zipper connector 118 to the slider body 114 may include mounting the zipper connector 118 and leaving the zipper connector 118 connected during zipping and/or unzipping of the zipper. In one embodiment, a lobster clasp 306, closable link 504, or other mechanism may be used that is easily manipulable for coupling and/or removal.

In one embodiment, the method 800 may include permanently connecting 804 a zipper connector 118 to an anchor location on a first placket tab 106. According to one embodiment, permanently connecting 804 the zipper connector 118 to an anchor location on the first placket tab 106 may include connecting the zipper connector 118 directly to the first placket tab 106 or to a portion of a securing mechanism 110 on the first placket tab 106. In one embodiment, permanently connecting 804 the zipper connector 118 to the anchor location on the first placket tab 106 may include connecting the zipper connector 118 such that it cannot be removed without damage to the zipper connector 118 and/or the placket and/or may require special tools. In another embodiment, permanently connecting 804 the zipper connector 118 to the slider body 114 may include mounting the zipper connector 118 and leaving the zipper connector 118 connected during zipping and/or unzipping of the zipper. In one embodiment, a lobster clasp 306, closable link 504, cord 302, or other mechanism may be used that is easily manipulable for coupling and/or removal.

In one embodiment, the method 800 may include detaching 806 a securing mechanism 110. For example, the securing mechanism 110 illustrated in FIGS. 1-2 and 9-10 may be detached to release a first placket tab 106 from a second placket tab 108. In one embodiment, the securing mechanism 110 is detached 806 prior to separating 702 the first and second placket tabs 106, 108. For example, the securing mechanism 110 may be detached 806 in preparation for putting an article of clothing on or removing the article of clothing. In one embodiment, detaching 806 a securing mechanism 110 may include removing a button from a buttonhole or button loop, releasing a hook from an eye, or any other detaching 806 technique for any securing mechanism 110.

In one embodiment, the method 800 may include attaching 808 a securing mechanism 110. For example, the securing mechanism 110 illustrated in FIGS. 1-2 and 9-10 may be attached 808 to secure a first placket tab 106 to a second placket tab 108. In one embodiment, the securing mechanism 110 is attached 808 following drawing 704 the first and second placket tabs 106, 108 together. For example, the securing mechanism 110 may be attached 808 in preparation to secure an article of clothing on an individual or for storage of the article of clothing. In one embodiment, attaching 808 a securing mechanism 110 may include inserting a button into a buttonhole or button loop, engaging a hook in an eye, or any other attaching 808 technique for any securing mechanism 110.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a first placket tab and a second placket tab located on opposing sides of a zipper, the zipper comprising a slider body;

a flexible zipper connector coupling the slider body to an anchor location on the first placket tab, wherein the zipper connector comprises, a non-stretchable cord forming a single loop, the loop comprising a length such that the zipper connector maintains the distance between the anchor location and the slider body to be substantially the same or less than the distance between the anchor location and the slider body in a closed position; and a clasp mechanism operatively coupled to the non-stretchable cord, wherein the length of the loop is greater than the distance between the anchor location and the slider body in the closed position such that the loop of the flexible zipper connector loops around the anchor location and back on itself, selectively engaging the clasp mechanism to couple the slider body to the anchor location.

2. The apparatus of claim 1, further comprising a securing mechanism for selectively securing the first placket tab to the second placket tab at a location near the closed position of the slider body.

3. The apparatus of claim 2, wherein the anchor location is at the same location as a portion of the securing mechanism.

4. The apparatus of claim 3, wherein the flexible zipper connector is coupled to the first placket tab via a portion of the securing mechanism.

5. The apparatus of claim 1, wherein the flexible zipper connector comprises a lobster clasp.

6. A method of opening and closing a zipper comprising a slider body in an article of clothing, the method comprising:

when the zipper is in a closed position, separating a first placket tab from a second placket tab and folding the zipper, causing an elongate, non-stretchable zipper connector connecting the slider body to the first placket tab to draw the slider body toward an open position;

wherein the non-stretchable zipper connector comprises, a cord forming a single loop, the loop comprising a length such that the non-stretchable zipper connector maintains a distance between an anchor location and the slider body to be substantially the same or less than the distance between the anchor location and the slider body; and a clasp mechanism operatively coupled to the non-stretchable cord, wherein the length of the loop is greater than the distance between the anchor location and the slider body in the closed position such that the loop of the flexible zipper connector loops around the anchor location and back on itself, selectively engaging the clasp mechanism to couple the slider body to the anchor location; and when the zipper is in the open position, drawing the first and second placket tabs together and straightening the zipper, causing the zipper connector to draw the slider body toward the closed position.

7. The method of claim 6, further comprising:

detaching a securing mechanism that selectively secures the first placket tab to the second placket tab; and attaching the securing mechanism to secure the first placket tab to the second placket tab, wherein the zipper connector secures the slider body in substantially the closed position when the securing mechanism is attached.

8. The method of claim 7, wherein separating the first placket tab from the second placket tab and folding the zipper is performed in response to detaching the securing mechanism and wherein attaching the securing mechanism is performed in response to drawing the first and second placket tabs together and straightening the zipper.

9. An article of clothing comprising:

a first placket tab and a second placket tab located on opposing sides of a zipper on an article of clothing, the zipper comprising a slider body; and a flexible zipper connector coupling the slider body to an anchor location on the first placket tab, wherein the zipper connector comprises, a non-stretchable cord forming a single loop, the loop comprising a length such that the zipper connector maintains the distance between the anchor location and the slider body to be substantially the same or less than that the distance between the anchor location and the slider body in a closed position; and a clasp mechanism operatively coupled to the non-stretchable cord, wherein the length of the loop is greater than the distance between the anchor location and the slider body in the closed position such that the loop of the flexible zipper connector loops around the anchor location and back on itself, selectively engaging the clasp mechanism to couple the slider body to the anchor location.

10. The article of clothing of claim 9, wherein the article of clothing is configured to be worn on and cover a portion of a user's body, and wherein with the zipper closed the article of clothing is substantially retained on the user's body and wherein with the zipper open the article of clothing is removable from the user's body.

11. The article of clothing of claim 9, wherein the article of clothing comprises trousers.

12. The article of clothing of claim 9, wherein the article of clothing comprises one of a shirt, a jacket, a coat, and a blouse.

13. The article of clothing of claim 9, wherein the article of clothing comprises one of a skirt and a dress.

14. The article of clothing of claim 9, further comprising a securing mechanism for selectively securing the first placket tab to the second placket tab at a location near the closed position of the slider body.

* * * * *